US006209305B1

(12) United States Patent
Paweletz

(10) Patent No.: US 6,209,305 B1
(45) Date of Patent: Apr. 3, 2001

(54) DRIVING AND SUPPORTING DEVICE FOR TRANSPORTING ROLLER FOR TEXTILE FIBERS

(75) Inventor: Anton Paweletz, Fellbach (DE)

(73) Assignee: SKF Textilmaschinen-Komponenten GmbH, Stuttgart (DE)

( * ) Notice: Subject to any disclaimer, the term of this patent is extended or adjusted under 35 U.S.C. 154(b) by 0 days.

(21) Appl. No.: 08/980,715

(22) Filed: Dec. 1, 1997

(30) Foreign Application Priority Data

Nov. 29, 1996 (DE) ..... 296 20 736

(51) Int. Cl.[7] ..... D01H 4/00
(52) U.S. Cl. ..... 57/412; 57/100; 19/258
(58) Field of Search ..... 57/412, 100; 19/258

(56) References Cited

U.S. PATENT DOCUMENTS 3,807,158 * 4/1974 Landwehrkamp et al. ..... 57/412
5,509,261 * 4/1996 Wassenhoven et al. ..... 57/412
5,673,548 * 10/1997 Raasch et al. ..... 57/412
5,689,946 * 11/1997 Schmid ..... 57/412
5,709,074 * 1/1998 Stahlecker ..... 57/412

FOREIGN PATENT DOCUMENTS

1675424 * 9/1991 (SU) ..... 19/258

OTHER PUBLICATIONS

Derwent 1997–088961; abstract of DE29620736, Nov. 1996.*

* cited by examiner

*Primary Examiner*—William Stryjewski
(74) *Attorney, Agent, or Firm*—Michael J. Striker

(57) ABSTRACT

A driving and supporting device for a transporting roller for textile fibers formed as a drawing roller in an open end spinning machine, the device has an electric motor for driving a transporting roller and having a drive shaft, a device part which is completely mechanically uncoupled from the drive shaft of the motor and supports the transporting roller in an axial and a radial direction.

13 Claims, 8 Drawing Sheets

DRIVING AND SUPPORTING DEVICE FOR TRANSPORTING ROLLER FOR TEXTILE FIBERS

BACKGROUND OF THE INVENTION

The present invention relates to a driving and supporting device for a transporting roller for textile fibers, in particular for a drawing roller of an open end spinning machine.

The drawing roller for an open end spinning machine guides the fiber material to be spinned to the machine. For transportation of the fibers, relatively high transfer forces are required. Also in rough spinning conditions, sporadically high radial and axial loads can occur during mounting, service or operation of the machine. The running accuracy of the drawing roller is decisive for the quality of the produced yarn. For the automatic spinning, a drive for the drawing roller which is independent from other parts, such as rotor drive and release roller, is of great advantage. As a rule, the drawing rollers of several spinning boxes have been centrally mechanically driven. An individual control of the individual drawing rollers of the spinning boxes is therefore however not possible. By means of an electrically controlled braking coupling, the drawing roller during the spinning process can be started, and in the event of a thread breakage, turned off.

Such a coupling however makes possible only two operational conditions: running with the rotary speed of the central drive or stopping. A stopping. A rotary speed regulation for example for spinning is not possible. Individual motor drives has been proposed for the drawing rollers, which are substantially flexible and with which high yam qualities could be realized. In the known individual motor drives, the drawing roller is supported on the drive shaft of the motor and thereby forces acting in the radial and axial direction on the drawing roller are completely transmitted to the motor bearing and their surface life is substantially limited. On the other hand, in the case of a separate mounting of shaft and motor they are coupled with one another. Such a coupling however occupies a substantial place. Moreover, the motor bearing remains loaded by transverse forces. The stepper motors are rigidly mounted on the machine. The vibration problems and the noise generation in the resonance region of the motor are a serious problem from the machines with 200–300 drive units.

SUMMARY OF THE INVENTION

Accordingly, it is an object of the present invention to provide a driving and supporting device for a transporting roller for textile fibers which avoids the disadvantages of the prior art.

In keeping with these objects and with others which will become apparent hereinafter, one feature of present invention resides, briefly stated, in a driving and supporting device for a transporting roller for textile fibers, in particular for a drawing roller for textile fibers in particular for a drawing roller of an open end spinning machine, in accordance with which the roller is driven by an electric motor having a drive shaft with a torque transmitted to the transporting roller, and the transporting roller is supported in an axial and a radial direction on a part which is mechanically completely uncoupled from the drive shaft of the motor.

In this construction the drive shaft of the motor does not serve simultaneously for supporting the transporting roller. During the torque transmission between the drive shaft of the motor and the transporting roller, the drive shaft of the motor however must take tangential forces and not the relatively great radial and axial forces which act on the transporting roller. The motor bearing is therefore loaded only a little and has a correspondingly long service life.

Advantageously, the electric motor can be formed as a stepper motor, in particular a hybride motor which is very accurately controllable. Hybride motors have very small reaction times and a high breaking moment, which is required in particular during a thread breakage. The proposed driving device is especially space-economical and can be easily mounted on a supporting plate. Advantageously the motor can be supported elastically on the supporting plate in the axial and radial direction. Thereby the adjustment of an optimal vibration condition of the motor or the whole unit of the motor and the bearing device is possible. As a result, an exceptionally high running quietness of the transporting rollers and the motors is provided which is characterized acoustically by a low noise level. In accordance with an advantageous embodiment of the invention, the motor and the transporting roller can be supported opposite to one another on different sides of the supporting plate. The transporting roller can be anchored for example in the axial and radial direction on a hollow supporting shaft anchored in an opening of the supporting plate.

In accordance with a first embodiment of the driving and supporting device, the drive shaft of the motor can pass through the opening of the supporting plate and through the hollow supporting shaft of the transporting roller. At its end, it can be elastically connected through driving elements with inner cylinder of the roller. In this arrangement, a very small space is needed for the arrangement. Transporting roller can be supported through rollers on the hollow bearing shaft.

Further advantages can be obtained when the hollow supporting shaft and the transporting roller form an assembly which is fixed in an axial direction by magnets to the supporting plate. Thereby the mounting of the bearing device of the transporting roller is especially simple. It includes a snapping mechanism acting in the axial direction. Also, the release of the transporting roller from the device and in some cases an exchange of the motor is therefore very simple.

The at least one driving element can be connected elastically with the drive shaft of the motor or the inner cylinder of the transporting roller. The elasticity must be high in the radial and axial direction, while in the tangential direction it is low. Thereby with a good torque transmission, an improved vibration uncoupling between the drive shaft of the motor and transporting roller is provided.

A further advantage of this arrangement is that both bearing systems operate independently from one another because of the two mechanically uncoupled axles of the transporting roller and the drive roller of the motor which are not radially axially loaded relative to one another. Instead of the direct torque transmission between the drive roller and the transporting roller, the drive roller of the motor can transmit its torque through a transmission to the transporting roller. The transmission can be designed so that no additional supporting points are needed. The use of the transmission has the advantage that the rotary speed-torque characteristic of the stepper motor can be better utilized.

By a corresponding selection of the conversion ratio, the step resolution of the drive can be again reduced. For this purpose, standard 1.8° stepper motors are utilized in full or half stepper operation. This makes possible a simple design of the control. The smaller torque of these stepper motors requires also a low power consumption. The transmission for transmitting the torque can be integrated in the hollow supporting shaft for the transporting roller.

In a third embodiment of the driving and supporting device, the motor and the transporting roller can be supported on a common hollow supporting shaft which is anchored in an opening of the supporting plate and projects at both sides outwardly beyond the supporting plate. In this case separate motor bearings are not needed and therefore a service life problem is resolved.

The inventive device is suitable not only for drawing rollers of open end spinning machines, but also generally for all applications in which a fiber band must be supplied with a relatively small speed and corresponding control. The release roller cooperating with the transporting roller and a fiber passage for a counter pressure roller, can be also supported on a common supporting plate. Supporting roller is preferably formed as a ridge roller. By a corresponding adaptation of the stepped resolution of the motor to the reaches of the transporting roller, an optimal supply of the fiber material can be produced. The step resolution amounts to a multiple of the resolution of the regions of the transporting roller.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
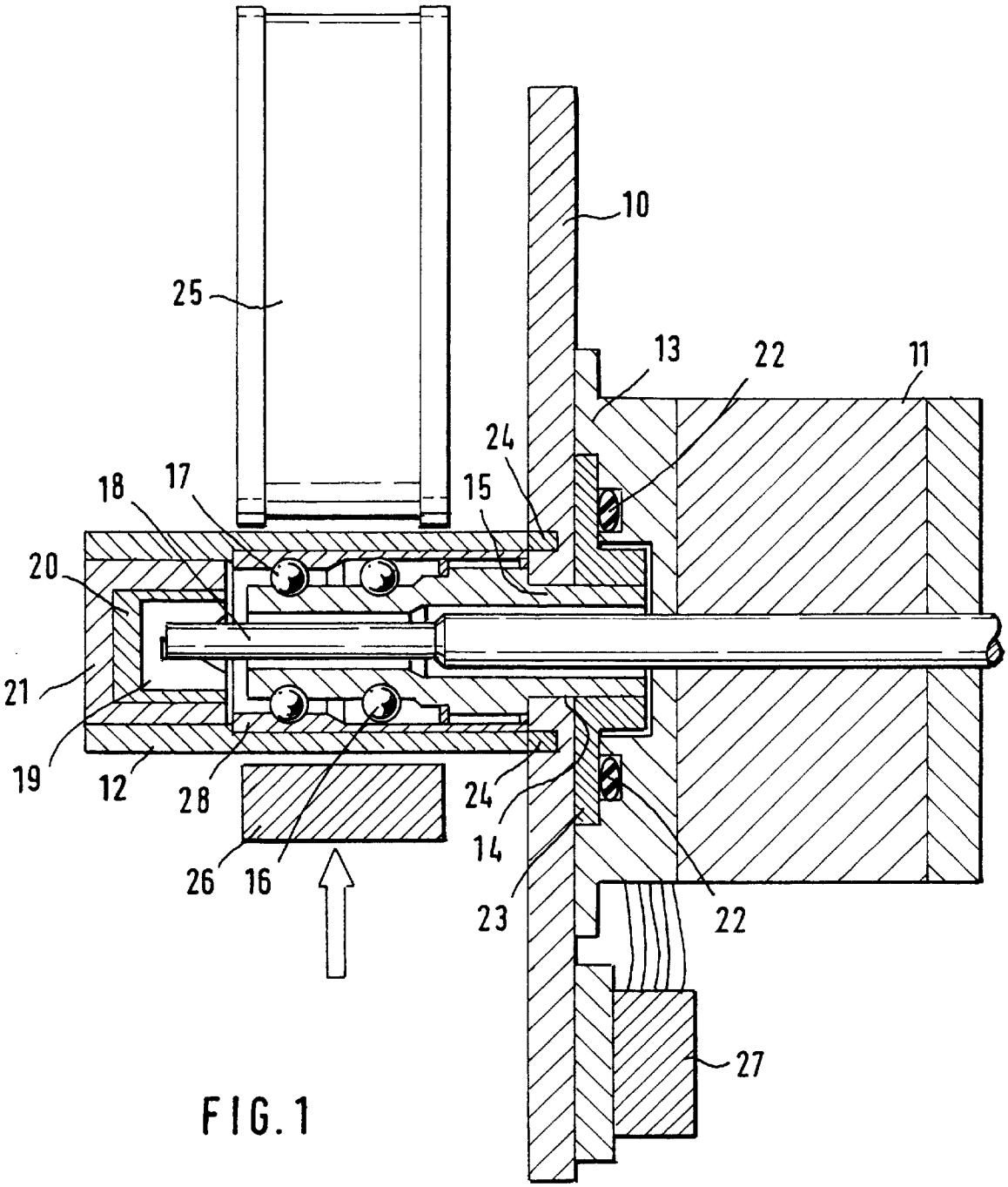
FIG. 1 is a view showing a central longitudinal section through a first device in accordance with the present invention with a direct drive of a transporting roller.

A driving and supporting device for a transporting roller shown in FIG. 1 has a supporting plate 10 with a stepper motor 11 at its one side and with a transporting roller 12 having a corrugated surface at the opposite side. The motor 11 is connected through a flange 13 with a supporting plate 10. The supporting plate 10 has a opening 14. A hollow supporting shaft 15 for the transporting roller 12 is arranged in the opening. The transporting roller 12 rotates on the hollow supporting shaft 15 through roller bearings 16 and 17. A drive shaft 18 of the motor 11 extends through the hollow supporting shaft 15.

An outer ring 28 of the integrated assembly 12, 16, 17 is connected with the transporting roller 12 through a sliding fit. A three-part driving element 19, 20, 21 is arranged at the end of the drive shaft 18 and transmits the torque of the drive shaft 18 to the inner cylinder of the transporting roller 12. The inner part 19 of the drive element is adjusted to for example a flattened shape of the drive shaft. The innermost drive element 20 is formed elastically in the radial and axial direction. The flange 13 of the motor 11 is connected through an elastic element 22 with a connecting piece 23 which is fixedly screwed with the supporting plate 10. The elastic elements 22 are designed for an optimal vibration condition of the drive.

Figure 1A:
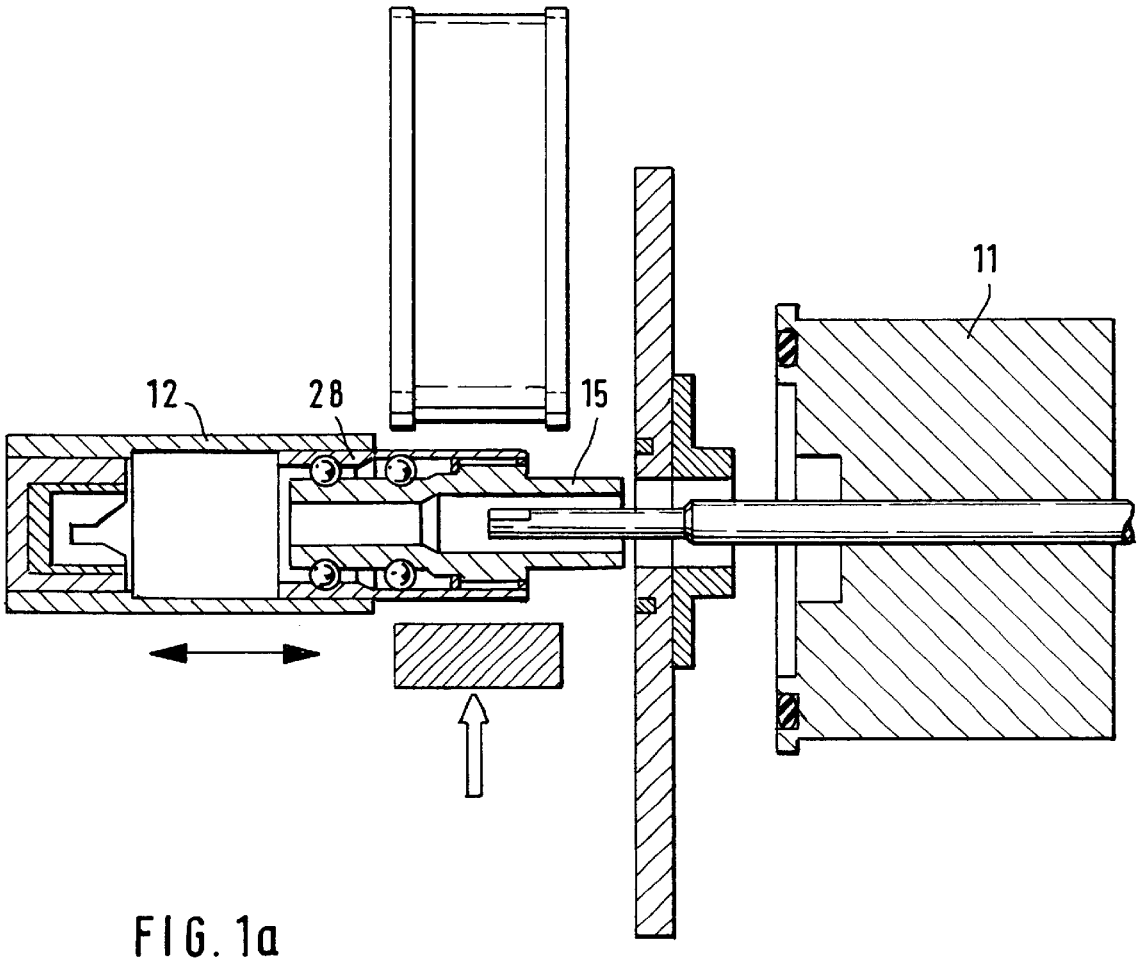
FIG. 1*a* is a view showing the transporting roller which forms a releasable unit with a hollow supporting shaft.

The transporting roller 12 forms with the hollow supporting shaft 15 a releasable unit which is shown in FIG. 1*a*. It is fixed in the axial direction by magnets 24 which are arranged on the supporting plate 10. FIG. 1 also shows a counterroller 25 which is formed here as releasing roller of an open end-spinning machine, as well as a fiber guiding element 26 and a control unit 27 for the motor 11. Also, the parts 25 and 27 are mounted on the supporting plate 10. As can be seen from FIG. 1*a,* the transporting roller can be easily removed for example by post-lubrication of the bearing.

Figure 2:
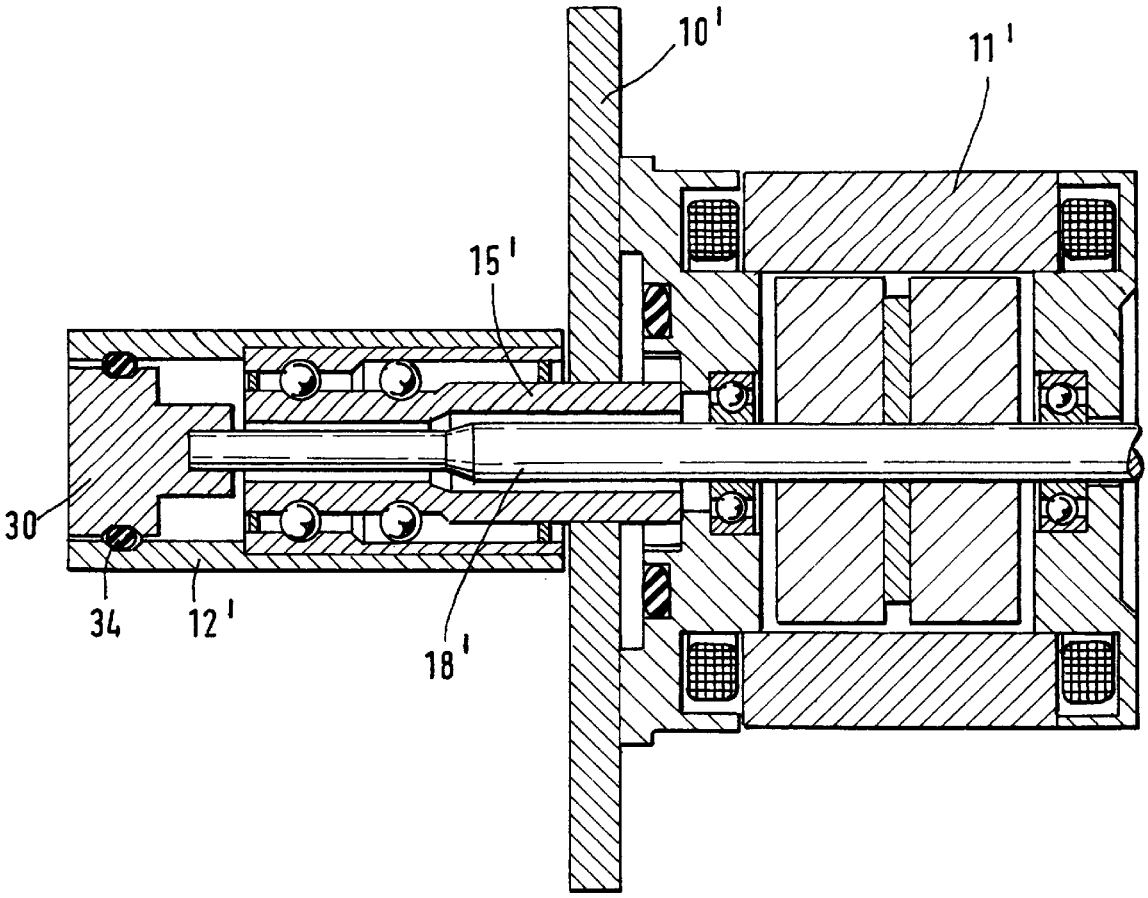
FIG. 2 is a view showing a central longitudinal section through a second embodiment of the inventive device with a direct drive of the transporting roller.

FIG. 2 shows a device which in principle is substantially similar to device of FIG. 1. A transporting roller 12' is also supported on a supporting plate 10' through a hollow supporting shaft 15'. The drive shaft 18 of the motor 11 is however fixedly connected with a rigid drive element 30, which furthermore is connected through an elastic connection 34 with the inner cylinder of the transporting roller 12' and transmits the torque of the drive shaft 18' of the motor 11' to the transporting roller 12'. The electrical connection takes the objective of mechanically uncoupling the bearing of the motor 11' and the bearing of the transporting roller 12' in the axial and radial directions.

Figure 3:
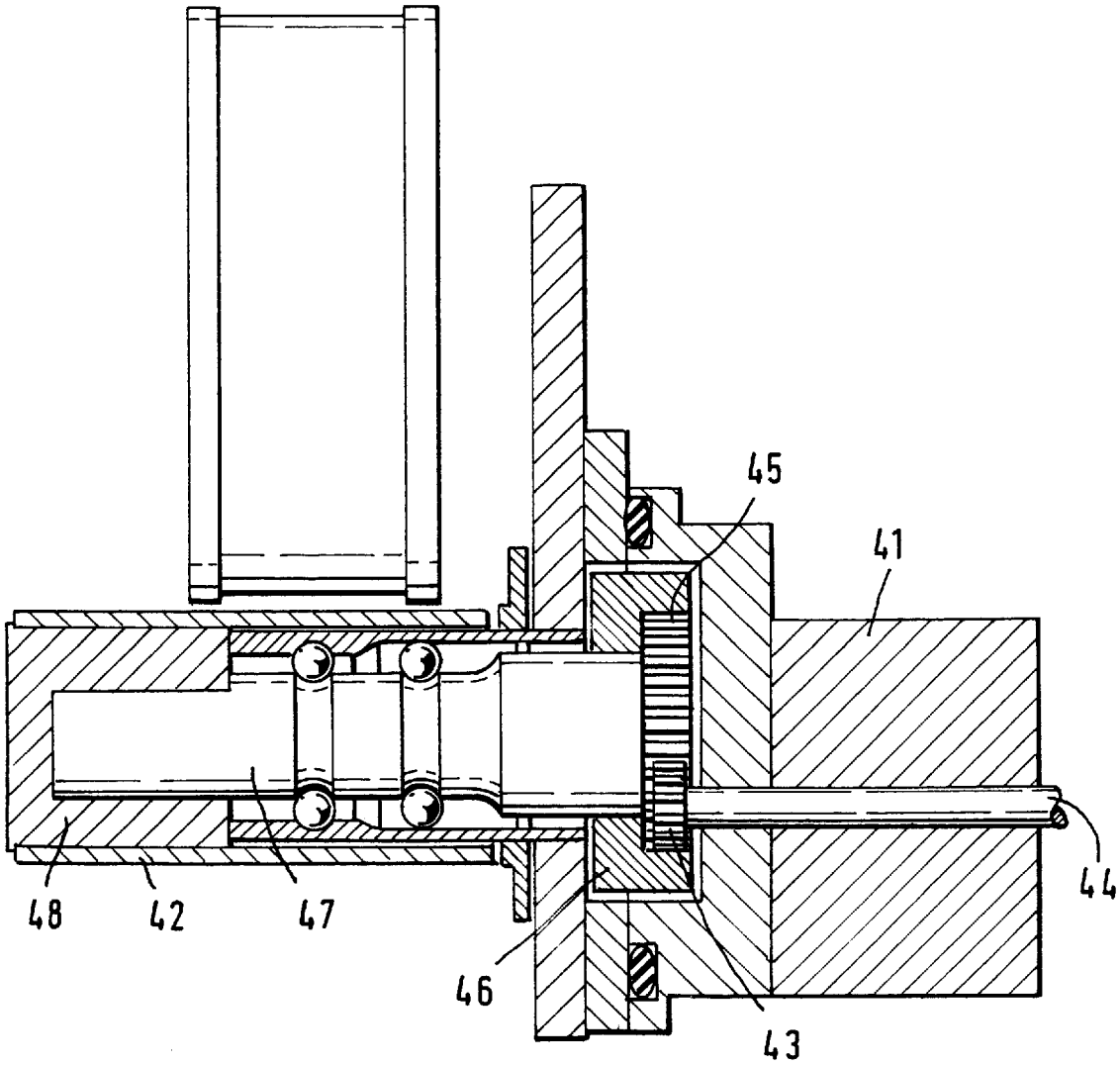
FIG. 3 is a view showing a central longitudinal section through a first device with a transmission drive for the transporting roller.

FIG. 1*a* is a view showing the transporting roller which forms a releasable unit with a hollow supporting shaft; roller 42 is coupled through a transmission. The transmission has a pinion 43 which is fixedly connected with the motor shaft 44. The pinion 43 engages in an inner toothing 45 of a receptacle 46 which is fixedly connected with a shaft 47. The shaft 47 is connected at its one end for joint rotation with a drive element 48, through which the torque of the shaft 47 is transmitted to the transporting. FIG. 3 shows a device in which a motor 41 is connected with a roller 42. The motor shaft 44 and the shaft 47 of the transporting roller 42 are offset relative to one another. In the solution shown in FIG. 3 no additional bearing locations for the transmission parts 43, 46, 47 are needed.

Figure 4:
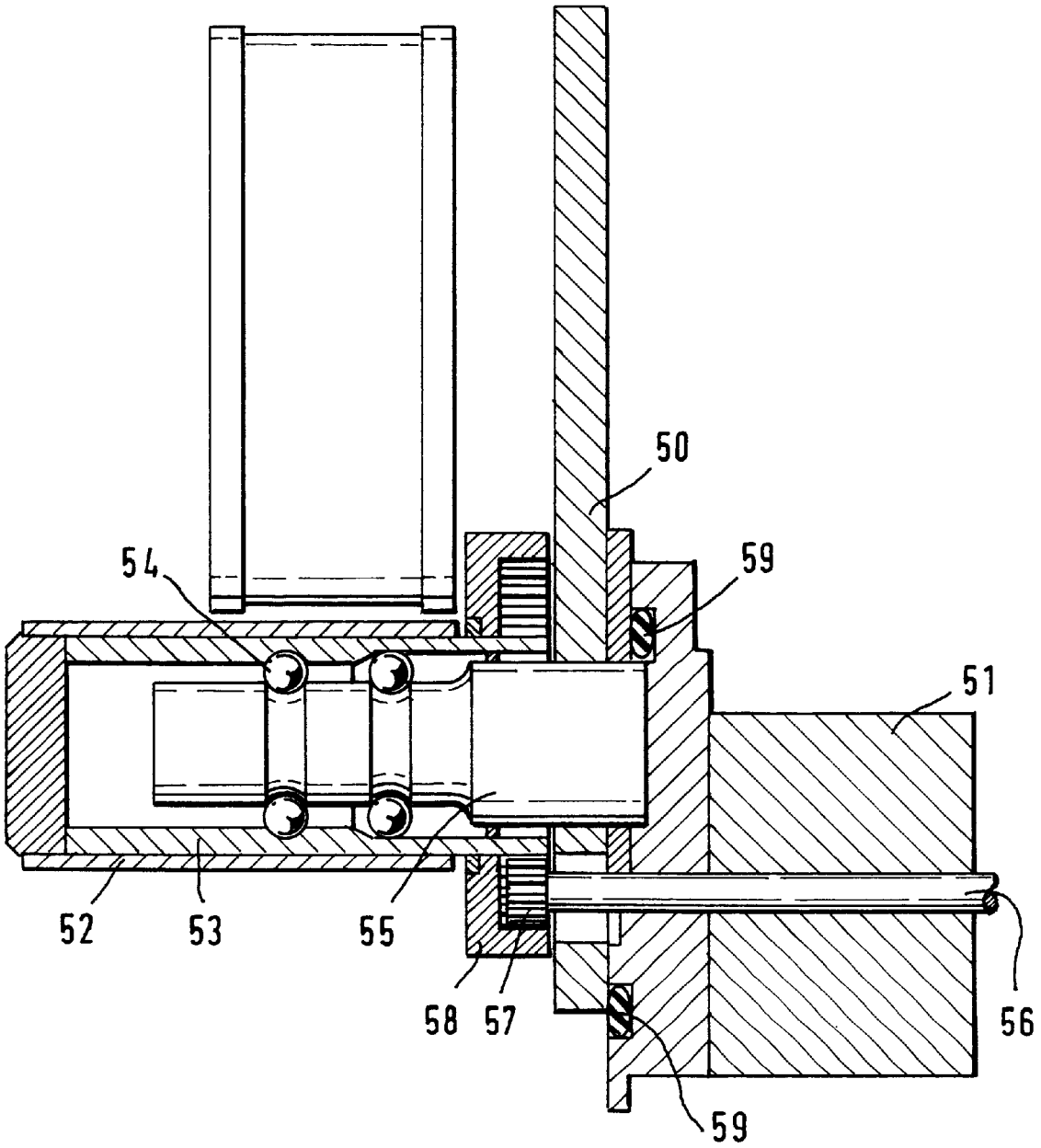
FIG. 4 is a view showing a central longitudinal section through a second device with a transmission for the transporting roller.

A further embodiment of the transmission between a motor 51 and a transporting roller 52 is shown in FIG. 4. Here the transporting roller 52 is fixedly connected with the hollow supporting shaft 53 which rotates on a shaft 55 through a roller bearing 54. The shaft 55 is fixedly mounted on the supporting plate 50. The motor shaft 56 transmits its torque through a pinion 57 to the inner toothing of a receiving element 58 which is fixedly connected with the hollow bearing shaft 53. The motor 51 is again mounted on the supporting plate through elastic element 59 so that a slight radial pretensioning of the of the transmission element 57 and 58 is produced. This slight radial pretensioning compensates for the radial gap of the bearing. Therefore the drive shaft 56 of the motor and transporting roller 52 are mechanically uncoupled from one another. In this embodiment, the are mechanically uncoupled from one another. In this embodiment, the bearings are available with a relatively great radial and axial gaps and thereby a cost-favorable construction is formed. The same is true for the solution of the transmission shown in FIG. 3. In this embodiment the motor shaft 56 and the bearing and driving unit 53 of the transporting roller 52 are offset relative to one another. Therefore, sufficient space is available on the device for mounting and required service works.

Figure 5:
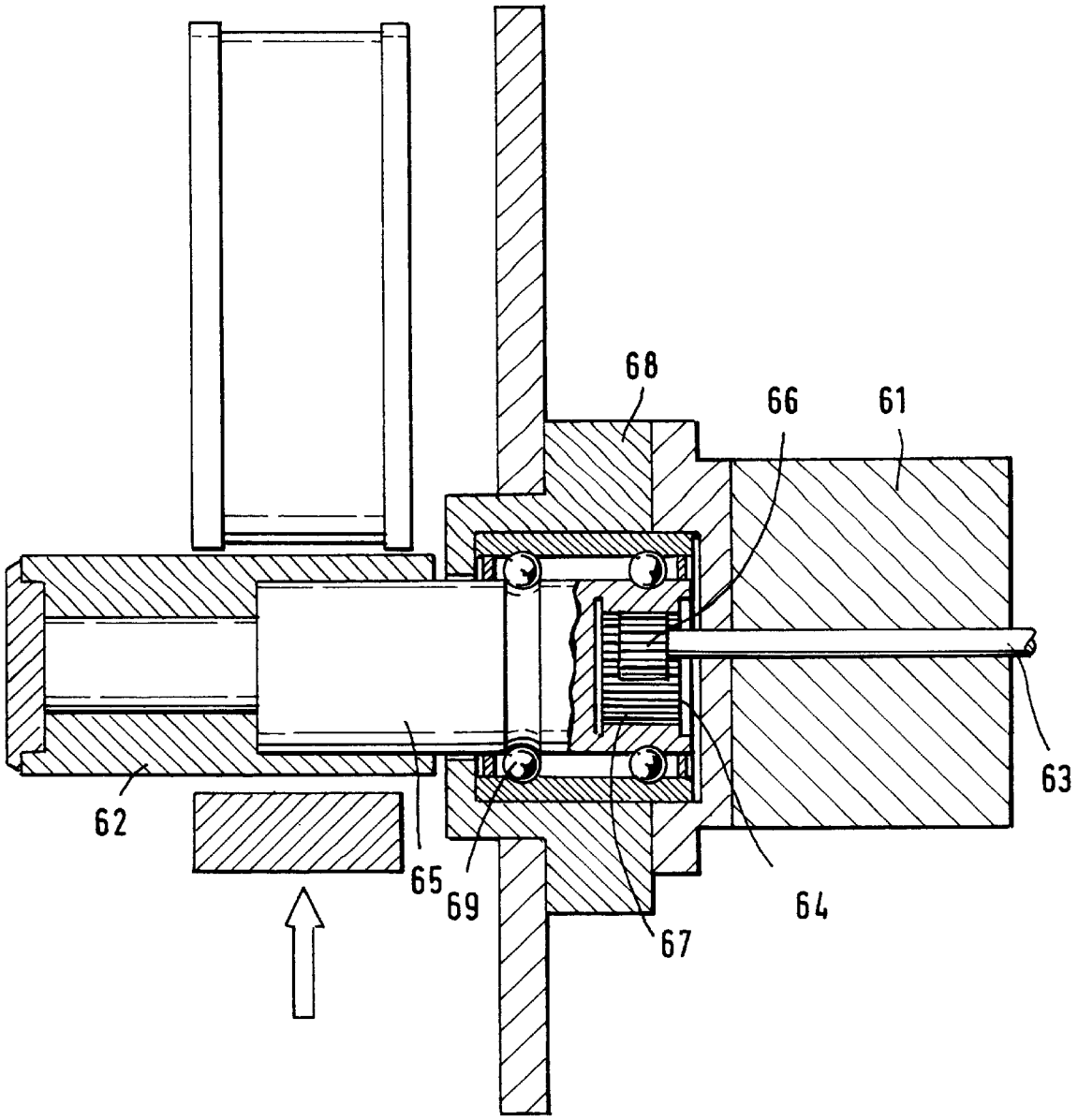
FIG. 5 is a view showing a central longitudinal section through a third device with a transmission for the transporting roller.

In a third embodiment of a transmission connection between a motor 61 and a transporting roller 62 shown in FIG. 5, the drive shaft 63 of the motor 61 extends into a recess 64 of a shaft 65, with which the transporting roller 62 is fixedly connected. Moreover, the transmission is arranged in the recess 64 and includes a pinion 66 and an inner toothing 67 on the shaft 65. The shaft 65 rotates in a receptacle 68 for the motor 61. In contrast to the devices shown in FIGS. 3 and 4, here the shaft 65 as well as the roller bearing 69 between the shaft 65 and the recess 68 can have a greater size, so that the service life of the device can be increased. The illustrated support is very space economical and stable.

Figure 6:
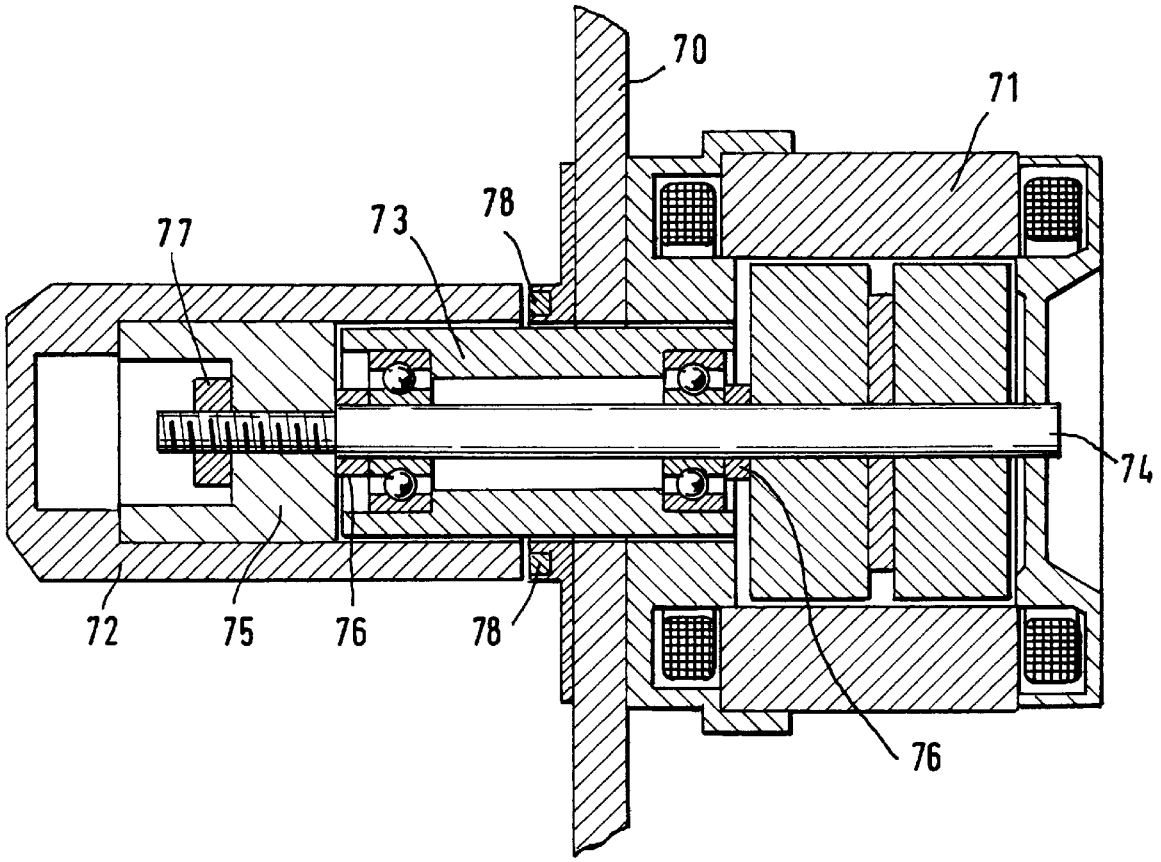
FIG. 6 is a view showing a central longitudinal section through a first device with a joint hollow bearing shaft for a drive motor and a transporting roller.
Figure 7:
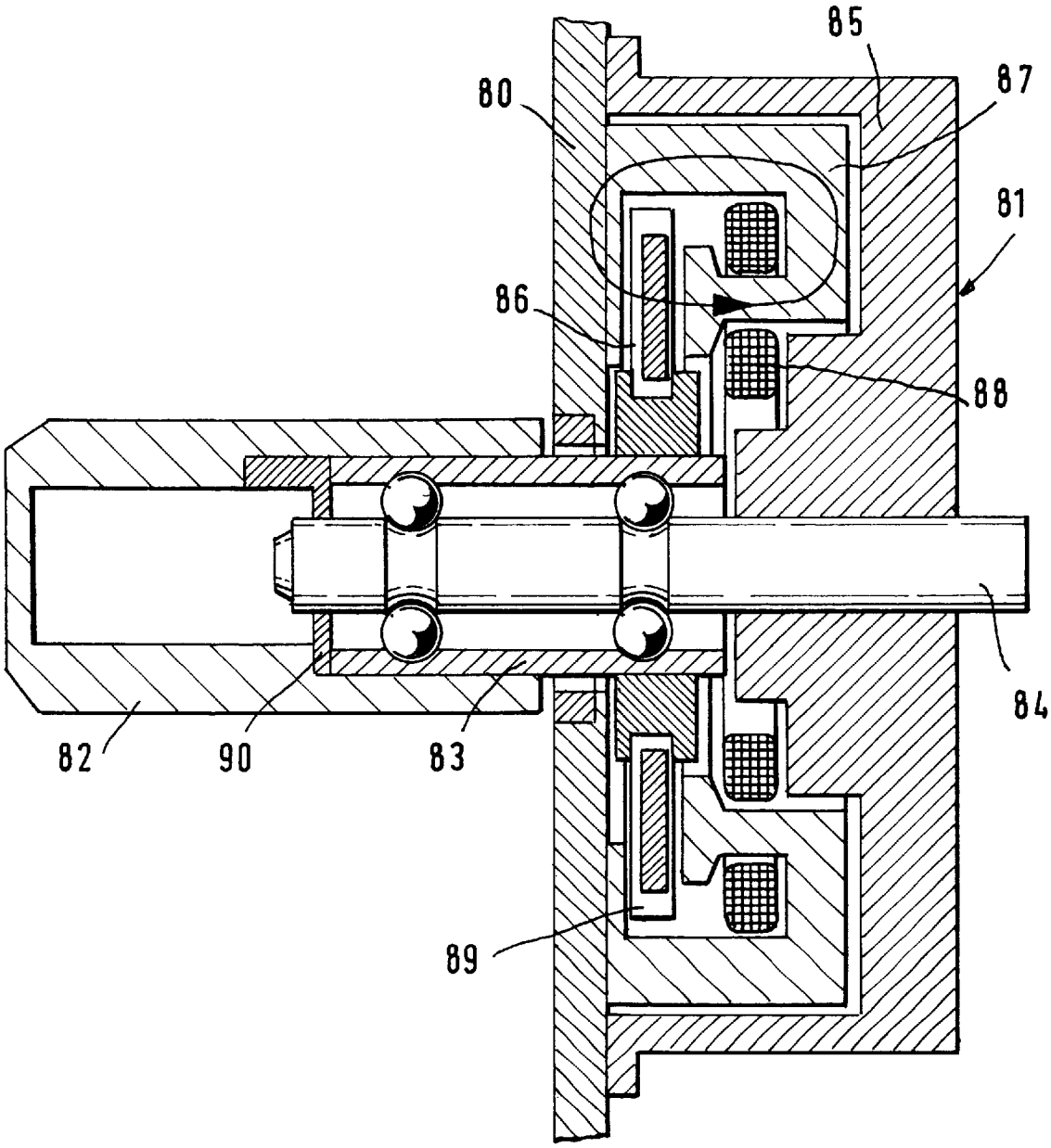
FIG. 7 is a view showing a central longitudinal section through a second device with a joint hollow supporting shaft for the drive motor and transporting roller.

FIGS. 6 and 7 show arrangements in which the motors 71 and 81 and the transporting roller 72 and 82 are supported in a common hollow supporting shaft 73 and 83. The hollow supporting shaft 73 and 83 extend 6 the motor shaft 74 drives the transporting roller 72 directly through a drive element 75. The shaft 74 rotates on the inner cylinder of the hollow supporting shaft 73 through a ball bearing. For the gap-free adjustment of the support, two springs 76 are provided. By corresponding tightening of a nut 77 at the end of the drive shaft 74, a corresponding pretensioning is produced and moreover the required pressure is obtained for a reliable driving of the connecting element 75. As in all previous examples, here again the transporting roller 72 is fixed in the axial direction by the magnet 78.

In the device of FIG. 7 a shaft 84 is fixedly mounted in a receptacle 85 of the motor 81. Drive magnets 86 of the motor 81 are located in the action region of the excitation field of a stator 87 and kidney-shaped stator windings 88. The torque is transmitted through a receptacle 89 to the hollow supporting shaft 83 of the transporting roller 82. The axial pulling force of the magnet 86 serves for the axial adjustment of the support through a spring 90 for the required gap-free running and driving of the transporting roller 62.

I claim:

1. A driving and supporting device for textile fibers, comprising a transporting roller formed as a drawing roller of an open end spinning machine; an electric motor for driving said transporting roller and having a drive shaft; a device part which supports said transporting roller; a common supporting plate which supports said motor and the transporting roller, said motor being elastically supported on said supporting plate in axial and radial directions of the transporting roller.

2. A driving and supporting device as defined in claim 1, wherein said electric motor is a stepper motor.

3. A driving and supporting device as defined in claim 1, wherein said stepper motor is a hybride stepper motor.

4. A driving and supporting device as defined in claim 1, wherein said motor and a supporting roller are supported opposite to one another at different sides of said supporting plate.

5. A driving and supporting device as defined in claim 1; and further comprising a supporting plate having an opening; a hollow supporting shaft anchored in said opening of said supporting plate and supporting said motor and the transporting shaft, said hollow supporting shaft extending at both sides over said supporting plate.

6. A driving and supporting device as defined in claim 1; and further comprising corrugation provided on the transporting roller.

7. A driving and supporting device as defined in claim 6, wherein said electric motor is a stepper motor having steps corresponding to said corrugation of the transporting roller.

8. A driving and supporting device for textile fibers, comprising a transporting roller formed as a drawing roller of an open end spinning machine; an electric motor for driving said transporting roller and having a drive shaft; a device part which supports said transporting roller; a supporting plate for supporting the transporting roller and having an opening, said device part being formed as a hollow supporting shaft which is anchored in said opening and supports the transporting roller in axial and radial directions of the transporting roller, said drive shaft of said motor extending through said hollow supporting shaft and having an end provided with drive means which is non-rotatably connected with an inner cylinder of the transporting roller.

9. A driving and supporting device as defined in claim 8; and further comprising means for rollingly supporting the transporting roller for rolling on said hollow supporting shaft.

10. A driving and supporting device as defined in claim 8, wherein said hollow supporting shaft and a transporting roller form a releasable unit; and further comprising magnet means which fix said releasable unit in a axial direction of said supporting plate.

11. A driving and supporting device as defined in claim 8, wherein said driving means is elastically connected with said drive shaft of said motor.

12. A driving and supporting device as defined in claim 8, wherein said driving means is elastically connected with the inner cylinder of the transporting roller.

13. A driving and supporting device for textile fibers, comprising a transporting roller formed as a drawing roller of an open end spinning machine; an electric motor for driving said transporting roller and having a drive shaft; a device part which supports said transporting roller; a supporting plate for supporting the transporting roller and having an opening, said device part being formed as a hollow supporting shaft which is anchored in said opening and supports the transporting roller in axial and radial directions of the transporting roller, said hollow supporting shaft and the transporting roller forming a releasable unit; and magnet means which fix said releasable unit in the axial direction of the transporting roller.

* * * * *